US007637803B2

(12) United States Patent
Welch

(10) Patent No.: US 7,637,803 B2
(45) Date of Patent: Dec. 29, 2009

(54) COMBINATION OF KNIFE BLOCK AND KNIFE SHARPENER WITH GUARD

(75) Inventor: Alan Rupert Welch, Stratford-upon-Avon (GB)

(73) Assignee: Robert Welch Designs Limited, Chipping Campden, Gloucestershire (GB)

( * ) Notice: Subject to any disclaimer, the term of this patent is extended or adjusted under 35 U.S.C. 154(b) by 0 days.

(21) Appl. No.: 12/133,494

(22) Filed: Jun. 5, 2008

(65) Prior Publication Data

US 2009/0149120 A1 Jun. 11, 2009

(30) Foreign Application Priority Data

Dec. 11, 2007 (GB) ..... 0724125.0

(51) Int. Cl.
*B23F 21/03* (2006.01)

(52) U.S. Cl. ..... 451/552; 451/555; 451/556; 30/138; 211/70.7

(58) Field of Classification Search ..... 451/45, 451/552, 555, 556, 917; 30/286, 298.4, 138, 30/139; 211/70.7
See application file for complete search history.

(56) References Cited

U.S. PATENT DOCUMENTS

| | | | | |
|---|---|---|---|---|
| 3,135,383 | A | 6/1964 | Block | |
| 3,583,104 | A * | 6/1971 | Petroske et al. | 451/241 |
| 4,502,218 | A * | 3/1985 | Carter et al. | 30/138 |
| 4,866,845 | A * | 9/1989 | McEvily | 30/138 |
| 4,869,027 | A * | 9/1989 | McEvily | 451/555 |
| 5,233,793 | A * | 8/1993 | Dandurand | 451/461 |
| 5,458,534 | A * | 10/1995 | Campione et al. | 451/555 |
| 5,494,176 | A * | 2/1996 | Zallo | 211/70.7 |
| 6,224,475 | B1 * | 5/2001 | May et al. | 451/555 |
| 6,581,774 | B1 | 6/2003 | Galafassi et al. | |
| D483,624 | S | 12/2003 | Bradshaw | |
| 6,676,490 | B1 * | 1/2004 | Kendhammer | 451/45 |
| 2003/0038098 | A1 * | 2/2003 | Stuchlik, III | 211/70.7 |
| 2005/0205506 | A1 | 9/2005 | Siegel | |
| 2007/0167122 | A1 * | 7/2007 | Henry | 451/523 |

FOREIGN PATENT DOCUMENTS

| | | | |
|---|---|---|---|
| DE | 202004004063 | U1 | 7/2004 |

* cited by examiner

*Primary Examiner*—Eileen P. Morgan
(74) *Attorney, Agent, or Firm*—MacMillan, Sobanski & Todd, LLC

(57) ABSTRACT

The combination of a knife storage block and a knife sharpener including a sharpening unit. The combination has a guard extending forwardly from either the knife storage block or the sharpener which in use protects a user's hand while drawing a knife through the sharpening unit. The knife sharpener may be external to the knife block or integral to it.

15 Claims, 6 Drawing Sheets

COMBINATION OF KNIFE BLOCK AND KNIFE SHARPENER WITH GUARD

CROSS-REFERENCE TO RELATED APPLICATIONS

Priority is claimed to United Kingdom patent application Serial No. GB0724125.0 filed Dec. 11, 2007.

STATEMENT REGARDING FEDERALLY SPONSORED RESEARCH OR DEVELOPMENT

Not Applicable.

TECHNICAL FIELD

The invention relates to a combination of a knife storage block and a knife sharpener.

BACKGROUND OF THE INVENTION

In the Applicant's co-pending U.S. patent application Ser. No. 12/016,562 there is described a knife sharpener which is received into an opening in the knife storage block, otherwise used for a steel, in order to provide an alternative sharpening facility that is readily available at all times. In that application the form of the knife sharpener is not restricted.

The Applicant has now developed a combination of a knife storage block and a knife sharpener which it is believed provides certain advantages over alternatives, as will become clear in due course.

BRIEF SUMMARY OF THE INVENTION

According to a first embodiment of the present invention there is provided a combination of a knife storage block and a knife sharpener. The knife sharpener includes a sharpening unit. The combination has a guard extending forwardly from the knife storage block or knife sharpener which in use protects the user's hand when they draw a knife through the sharpening unit.

According to another embodiment of the present invention there is provided a knife sharpener specifically adapted for use in a combination with a knife storage block according to the first aspect of the invention. The knife sharpener may be readily removable from the knife storage block without the need for tools.

The knife sharpener may comprise, on the underside of the housing, an elongate portion for receipt in an opening in a knife storage block or the like during use.

The elongate portion may bear retention formations which assist in retaining it within the opening in a knife storage block or the like during use.

Various objects and advantages of the invention will become apparent from the following detailed description of the invention and the accompanying drawings.

DETAILED DESCRIPTION OF THE INVENTION

Figure 1:
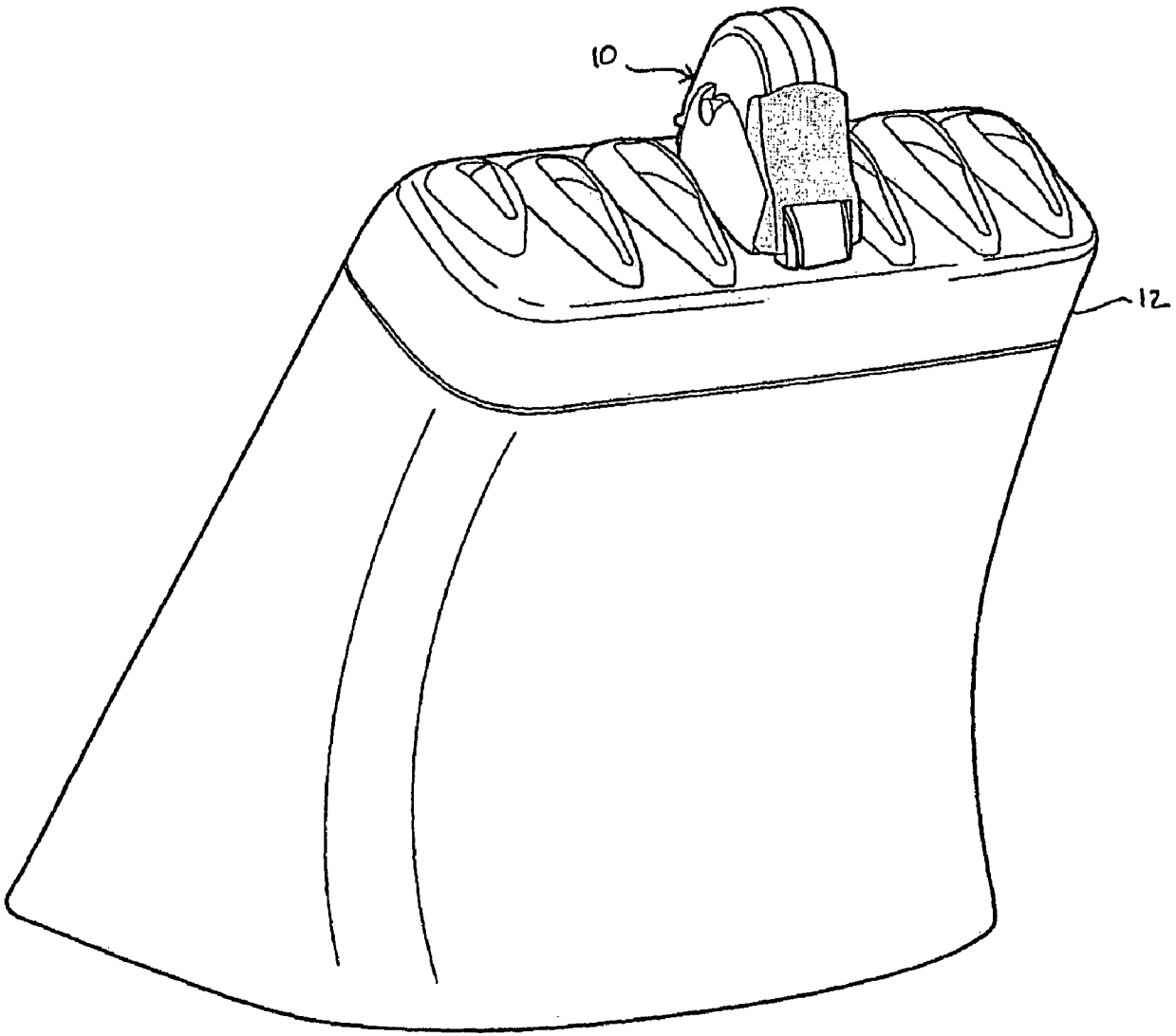
FIG. 1 is a perspective view of a first embodiment of a combination of a knife storage block with a knife sharpener according to the invention, where the knife sharpener is external to the knife block.

Referring first to FIG. 1 a knife sharpener 10 is located for use in an opening in the top of a knife storage block 12. Preferably the knife sharpener 10 is located in an opening (not shown) which would otherwise receive a sharpening steel for storage between uses, but may be a different opening if appropriate, or the knife sharpener may be retained on the knife storage block by an alternative method.

Referring now to FIGS. 2 to 5, the knife sharpener 10 has a housing 14 comprising a lower part 14*a* and an upper part 14*b*. The lower part 14*a* includes a recess 16. The upper part of the housing 14*b* is movable relative to the lower part 14*a* from a closed position as shown in FIGS. 2-5 to an open position (not shown). Preferably this is achieved by the upper part 14*b* being pivotable relative to the lower part 14*a*. In the embodiment illustrated pivoting is achieved by pressing downwardly on tang 20 projecting from the rear of the upper part 14*b*.

The knife sharpener 10 further includes a sharpening unit having a pair of ceramic wheels (not shown) mounted on an axle 18. The axle 18 is located in the recess 16 in the lower part of the housing 14*a*. The axle 18 is retained in place in the recess 16 by the upper part of the housing 14*b* when that is in it's closed position as shown in FIGS. 2 to 5. When retained the sharpening unit is free to rotate in the recess 16 as required for optimum operation during use sharpening a knife.

The upper part of the housing 14*b* includes a slot 22 which permits access to the sharpening unit by a knife blade when it is desired to sharpen the knife blade, in known fashion.

Figure 2:
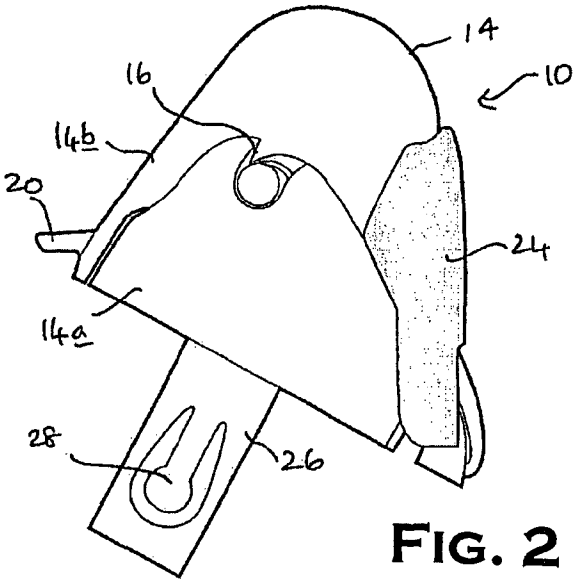
FIGS. 2 and 3 are two different perspective views of the knife sharpener of FIG. 1 with the flap in it's storage position.
Figure 4:
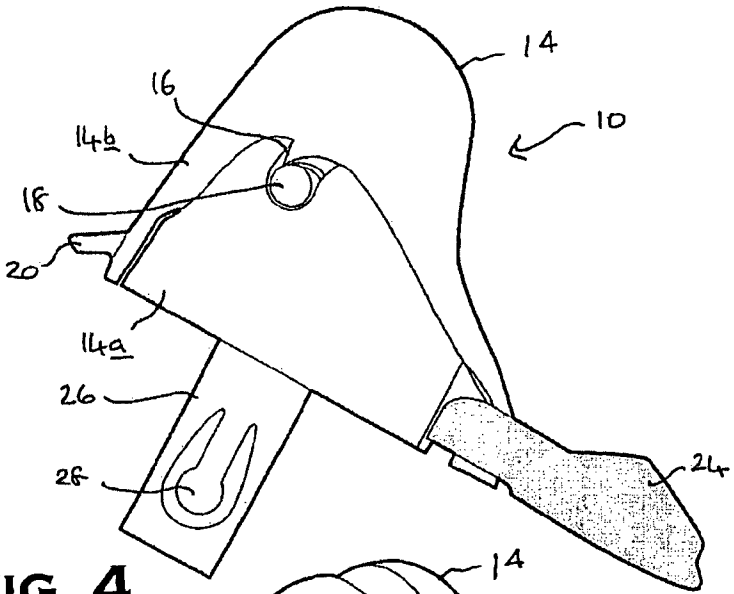
FIGS. 4 and 5 are two different perspective views of the knife sharpener of FIG. 1 with the flap in it's use position.
Figure 3:
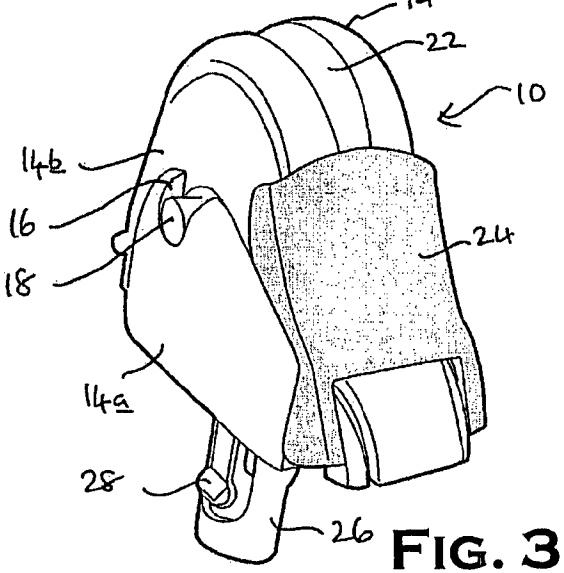
Figure 5:
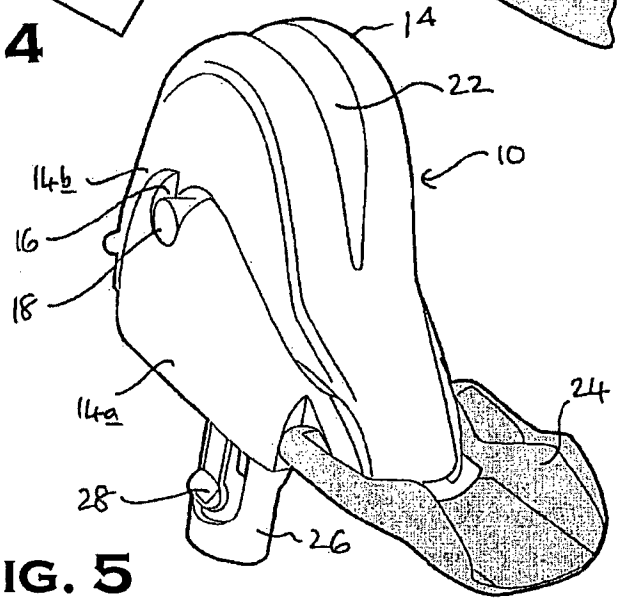
Figure 6:
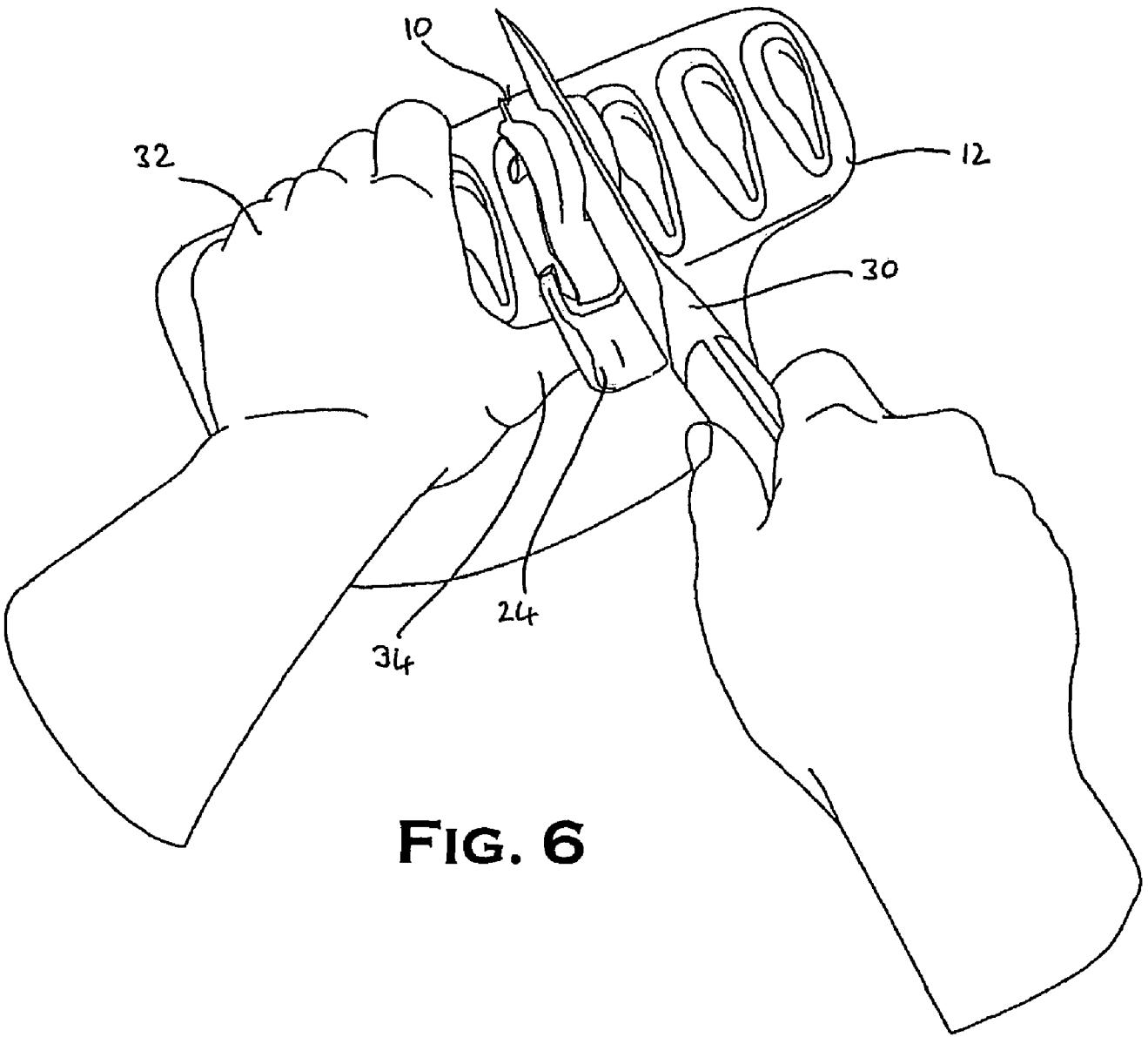
FIG. 6 is a perspective view from above of the knife sharpener of FIG. 1 in use.

The knife sharpener 10 further includes a flap 24 which is movable relative to the housing 14. In this case specifically pivotable relative to the lower part of the housing 14*a*, between a closed or storage position as shown in FIGS. 2 and 3 and a use position as shown in FIGS. 4 and 5. In the storage position the flap 24 obscures part of the slit 22 and prevents use of the knife sharpener 10. In the in use position the flap 24 no longer obscures part of the slit 22, and the knife sharpener 10 can be used. In the in use position the flap 24 also acts as a guard, such that if the user places a hand 32 (FIG. 6) on the top of the knife storage block 12 adjacent the knife sharpener 10, with a thumb 34 along the front of the knife storage block 12 below the knife sharpener 10, then the flap 24 prevents a knife 30 being sharpened from slipping out of the front of the slot 22 and cutting the user's thumb 34 or any other part of the user's hand 32.

It will be understood by those skilled in the art that other forms of guard could be incorporated into the knife sharpener 10. For example the flap 24 can be mounted on the housing 14 to be slidable or rotatable between storage and in use positions, whilst still providing the same functionality. Alternatively a guard can be provided as part of the knife storage block 12 rather than as part of the knife sharpener 10, as illustrated in connection with an internal knife sharpener in FIGS. 8 and 9.

Figure 7:
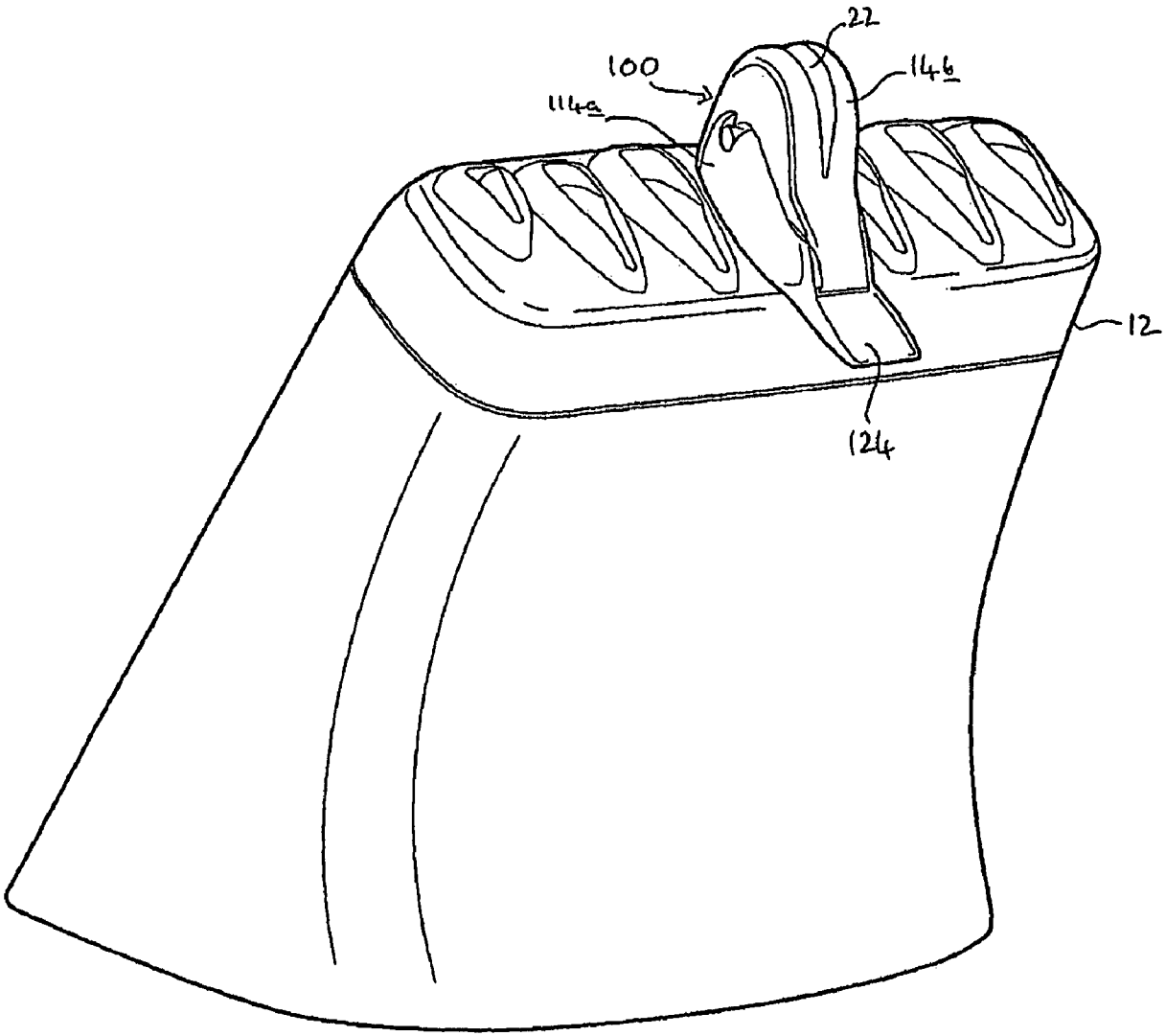
FIG. 7 is a perspective view of a second embodiment of a combination of a knife storage block with a knife sharpener according to the invention, where the sharpener is again external to the storage block.

Referring now to FIG. 7, an alternative embodiment of a knife sharpener 100 according to the invention is illustrated in place in a knife storage block 12. In this embodiment, in which like parts are like referenced, there is no flap 24, instead the lower part of the housing 114*a* includes a forwardly extending portion 124 which acts as a guard when the knife sharpener 100 is in use, and which is fixed in that position. Fixed guards with similar functionality may of course be provided separately from the lower part of the housing of the knife sharpener, and take different forms.

The knife sharpener 10 or 100 further includes an elongate portion 26 (FIGS. 2-5) extending downwardly from the bottom of the lower part of the housing 14*a* which is inserted into the opening (not shown) in the knife storage block 12 in order to locate the knife sharpener 10 in the knife storage block 12 for use. The elongate portion 26 preferably bears one of more retention formations 28 which assist in retaining the knife sharpener 10 in the opening in the knife storage block 12 during use. This method of securing the knife sharpener 10 in the knife storage block 12 during use means that the knife sharpener 10 is readily removable from the knife storage block 12 without the need for tools.

The illustrated extension 26 is sized and shaped to fit into a square opening for a conventional knife sharpening steel. Alternately, it can have a generally flat shape for fitting into one of the knife openings in the knife storage block 12.

It will also be understood by those skilled in the art that embodiments of knife sharpeners may be included in combinations according to the invention using other means by which they are secured to the knife storage block 12. Such means may mean that the knife sharpeners are removable or may mean that they are permanently or semi-permanently secured to the knife storage block. For example embodiments of knife sharpeners may be secured to a knife storage block by means of threaded fasteners, in which case they would be semi-permanently secured as tools would probably be needed to remove them. Embodiments of knife sharpener may alternatively be secured to a knife storage block by permanent means such as adhesive.

Figure 8:
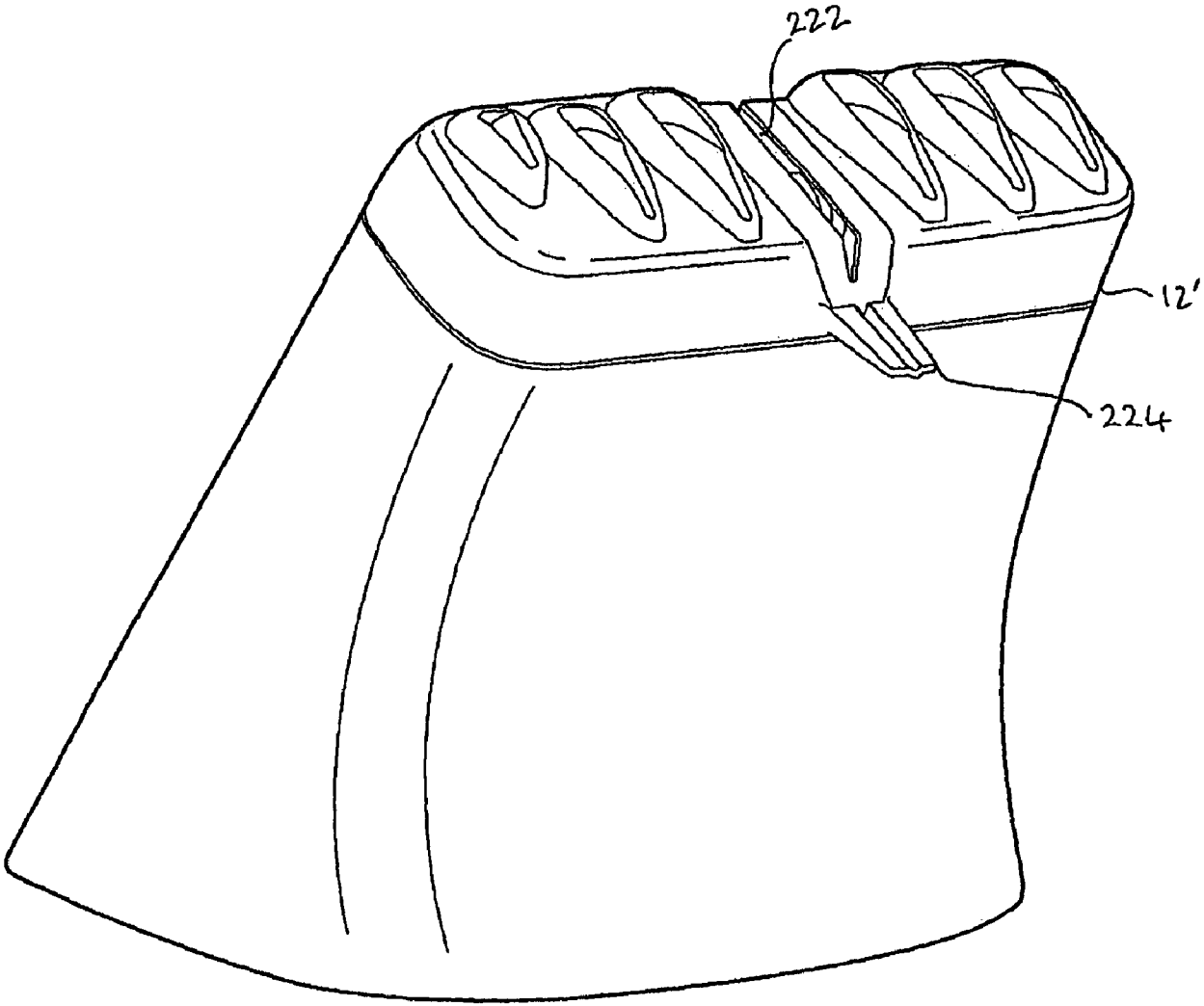
FIG. 8 is a perspective view of a third embodiment of a combination of a knife storage block with a knife sharpener according to the invention, where the sharpener is internal to the storage block.
Figure 9:
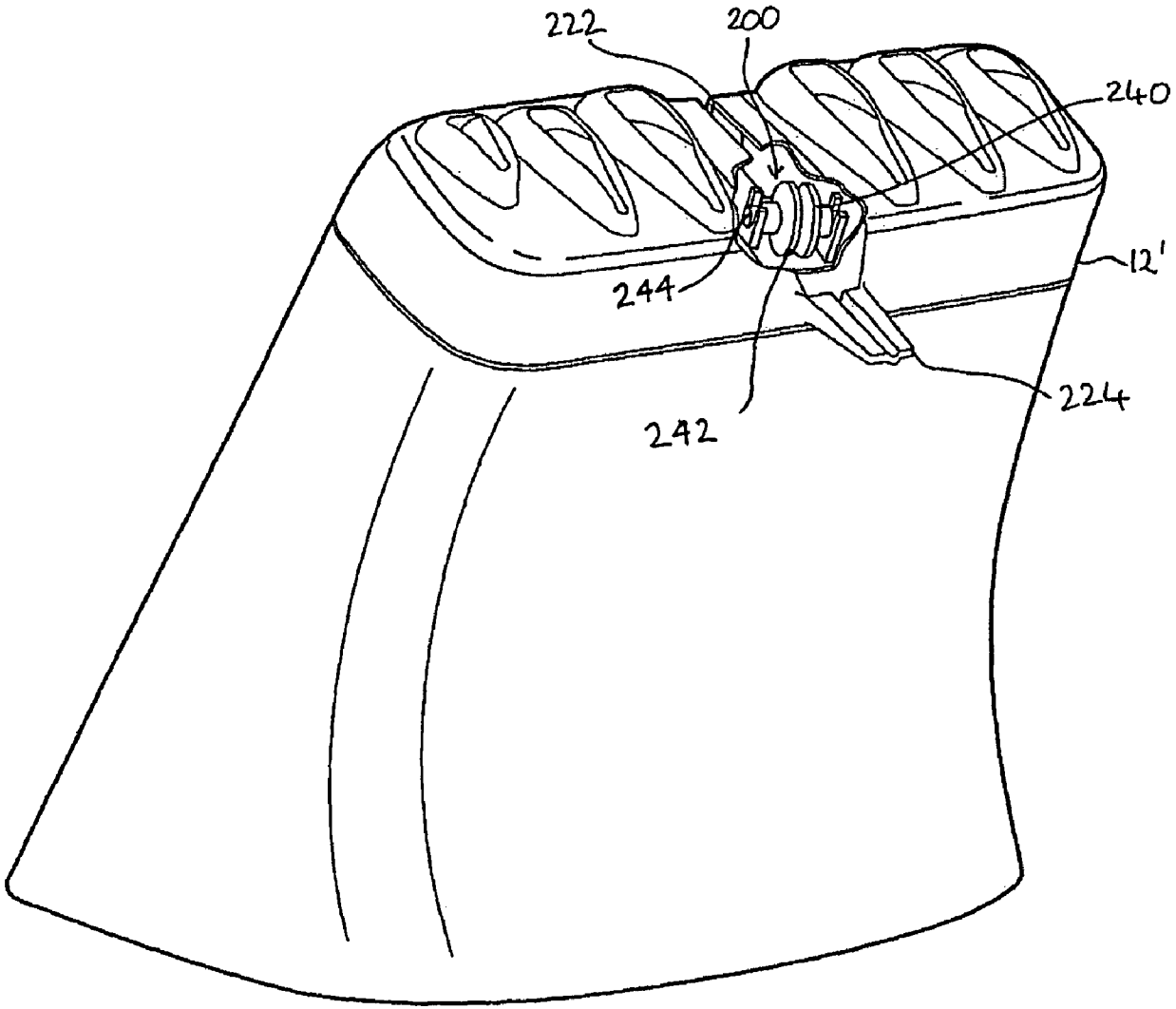
FIG. 9 is a partially cut away view of the embodiment of FIG. 8 to show the knife sharpener within the storage block.

Referring now to FIGS. 8 and 9, a third embodiment of a combination of a knife storage block 12' and a knife sharpener 200 are illustrated. The knife sharpener 200 is located internally to the knife storage block 12'. The knife storage block 12' has a guard 224 which extends forwardly from a position below a front end of a slot 222 which provides access for a knife (not shown) to a sharpening unit 240 (as shown in FIG. 9). The sharpening unit is shown as having two ceramic wheels 242 which rotate on an axle 244. The illustrated guard 224 is a fixed part of the knife block 12'. Alternately, it can pivot over the slot 222 or it can be mounted to slide into the housing 12'.

It should be understood that the sharpening unit may be of an alternative form to that described above, for example it may have metal wheels in place of the ceramic ones, or be of a very different form.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A combination of a knife storage block and a knife sharpener mounted in an opening in the storage block, the knife sharpener including a sharpening unit within a housing, the sharpening unit and housing extending externally from the storage block opening for use in sharpening a knife which is not in the knife storage block while the knife sharpener is mounted in said storage block opening, wherein the housing abuts the storage block during use, and the combination having a guard attached to and extending forwardly from the knife sharpener which in use protects the user's hand when a knife is drawn through the knife sharpener.

2. A combination according to claim 1 wherein the a housing is from which the guard extends forwardly.

3. A combination according to claim 2 wherein the guard takes the form of a flap moveable between a storage position in which access to the knife sharpener is restricted and a use position in which it extends forwardly permitting access to the sharpening unit and the flap acts as a guard.

4. A combination according to claim 3 wherein the flap is pivotable between the storage and use positions.

5. A combination according to claim 3 wherein the flap is slidable between the storage and use positions.

6. A combination according to claim 3 wherein the flap is rotatable between the storage and use positions.

7. A combination according to claim 1 wherein the sharpening unit comprises a pair of ceramic wheels fixed to an axle with a small gap there between.

8. A combination according to claim 1 wherein the knife sharpener is readily removable from the knife storage block without the need for tools.

9. A combination according claim 8 wherein the knife sharpener includes a housing having on an underside of the housing an elongate portion for receipt in the knife storage block opening.

10. A combination according to claim 1 wherein the knife sharpener is permanently secured to the knife storage block opening.

11. A combination of a knife storage block and a knife sharpener, the knife sharpener including a sharpening unit, and the combination having a guard extending forwardly from at least one of the knife storage block and the knife sharpener which in use protects the user's hand when they draw a knife through the sharpening unit, wherein the knife sharpener is external to the knife storage block and the knife sharpener has a housing from which the guard extends forwardly, and wherein the housing has a lower part and an upper part, the lower part of the housing having a recess into which the sharpening unit sits and the sharpening unit is retained in place in the recess by the upper part of the housing.

12. A combination according to claim 11 wherein the upper part of the housing is movable relative to the lower part of the housing between a closed position in which it retains the sharpening unit in place and an open position in which the sharpening unit may be removed.

13. A combination according to claim 12 wherein the upper part of the housing is pivotable relative to the lower part of the housing.

14. A combination according to claim 11 wherein the sharpening unit can rotate freely in the recess.

15. A combination of a knife storage block and a knife sharpener, the knife sharpener including a sharpening unit, and the combination having a guard extending forwardly from at least one of the knife storage block and the knife sharpener which in use protects the user's hand when they draw a knife through the sharpening unit, wherein the knife sharpener is readily removable from the knife storage block without the need for tools, wherein the knife sharpener includes a housing having on an underside of the housing an elongate portion for receipt in an opening in a knife storage block, and wherein the elongate portion bears retention formations which assist in retaining the elongate portion within the opening in a knife storage block during use.

* * * * *